US005845177A

United States Patent [19]

Choi

[11] Patent Number: 5,845,177

[45] Date of Patent: Dec. 1, 1998

[54] METHOD AND APPARATUS FOR PREVENTING DEFORMATION AND CONTAMINATION OF AN OPC DRUM IN AN ELECTROPHOTOGRAPHIC IMAGE FORMING APPARATUS

[75] Inventor: Bong-Hwan Choi, Suwon, Rep. of Korea

[73] Assignee: SamSung Electronics Co., Ltd., Suwon, Rep. of Korea

[21] Appl. No.: 792,673

[22] Filed: Jan. 29, 1997

[30] Foreign Application Priority Data

Jan. 29, 1996 [KR] Rep. of Korea ..... 1996-1194

[51] Int. Cl.[6] ..... G03G 15/02; G03G 21/00

[52] U.S. Cl. ..... 399/115; 399/176; 361/225

[58] Field of Search ..... 399/176, 174, 399/115; 361/225, 221

[56] References Cited

U.S. PATENT DOCUMENTS 4,387,980 6/1983 Ueno .
5,095,335 3/1992 Watanabe et al. .
5,390,007 2/1995 Kugoh et al. ..... 361/225 X
5,420,671 5/1995 Kisu et al. .
5,465,136 11/1995 Watanabe .
5,585,896 12/1996 Yamazaki et al. ..... 361/221 X
5,629,755 5/1997 Ohtsuka ..... 399/176
5,638,158 6/1997 Sanpe et al. ..... 399/174

*Primary Examiner*—R. L. Moses
*Attorney, Agent, or Firm*—Robert E. Bushnell, Esq.

[57] ABSTRACT

According to this invention, the contact and separation conditions between an OPC drum and a charger roller are controlled by utilizing a tension spring, which is connected between a frame and a bearing through which the shaft of the charger roller extends, for separating a driving gear of the OPC drum and a driven gear of the charger roller by a predetermined distance in order that the OPC drum and the charger roller can be separated while the OPC drum is at standstill, in order to prevent the charger roller from deforming or contaminating the OPC drum. The force of the tension spring is overcome by the force generated by the driving gear engaging the driven gear to enable the OPC drum and the charger roller to again contact each other while the OPC drum is rotated.

17 Claims, 2 Drawing Sheets

METHOD AND APPARATUS FOR PREVENTING DEFORMATION AND CONTAMINATION OF AN OPC DRUM IN AN ELECTROPHOTOGRAPHIC IMAGE FORMING APPARATUS

This application makes reference to, incorporates the same herein, and claims all benefits accruing under 35 U.S.C. § 119 from applications for Contamination Preventive System Of An OPC Drum Used For An Electrophotographic Image Forming Apparatus earlier filed in the Korean Industrial Property Office on 29 Jan. 01996, and there duly assigned Ser. No. 96/1194.

FIELD OF THE INVENTION

The present invention relates generally to a method and apparatus for preventing deformation and contamination of an organic photoconductive drum (OPC drum) used in an electrophotographic image forming apparatus such as a laser printer or a copier. More particularly, this system separates a charger roller from the OPC drum when the OPC drum is at a standstill so that the OPC drum is not deformed nor contaminated by the charger roller.

DESCRIPTION OF THE PRIOR ART

In a typical electrophotographic image forming apparatus, a charger roller, exposing device, developing device and transferring device are fundamentally arranged in order around an OPC drum in the direction of rotation. In such devices, electrophotographs are produced through a series of steps: the charger roller charges the surface of the rotating OPC drum, the surface is then exposed to the exposing device to create an electrostatic latent image thereon, toner in the developing unit is by a developing roller to the surface of the OPC drum to develop the electrostatic latent image, the toner image is transferred on a paper by the transferring device, and the fusing device fuses the toner image on the paper to complete the process.

The foregoing typical electrophotographic image forming apparatus is discussed in, for example, U.S. Pat. No. 5,095,335 to Kazushi Watanabe et al. entitled Copier With Retractable Charging Unit To Prevent Damage To Drum When Removing Process Cartridge and U.S. Pat. No. 5,420,671 to Hiroki Kisu et al. entitled Charger And Image Forming Apparatus With Same.

A more detailed description and operation is described with reference to FIG. 1 showing a cross sectional view of an examplary electrophotographic image forming device.

When a voltage of 1 to 7 kV is applied to the shaft of the charger roller 2 functioning as a charger, an electric field is formed between the OPC drum 1 and the charger roller 2 so that OPC drum 1 is uniformly charged. OPC drum 1 is then rotated an exposing device 3 the uniform charge on OPC drum 1 is then partially erased by a light beam from exposing device 3 to create an electrostatic latent image. The electrostatic image is then conveyed to developing device 4 as OPC drum 1 continues to rotate. Due to the electric field generated between OPC drum 1 and developing device 4, toner is supplied to the electrostatic latent image on OPC drum 1, and the electrostatic latent image is changed to a visible toner image. Then transferring device 5 is biased, enabling the toner image to be transferred to paper 16 in response to the rotational movement of OPC drum 1. OPC drum 1 is then cleaned by cleaning device 6, and the remaining charge on OPC drum 1 is removed by discharging device 7.

In such an examplary electrophotographic image forming device of FIG. 1, the contact of the charger roller and the OPC drum is described below in detail with reference to FIGS. 2A and 2B.

As shown in FIGS. 2A and 2B, a driving gear 8 is provided at one end of a shaft of OPC drum 1, and a driven gear 9 rotated in association with the driving gear 8 is provided at one end of a shaft of charger roller 2. To support charger roller 2, a pair of bearings 10 are each provided at opposite ends of the shaft of charger roller 2 with one bearing 10 disposed between charger roller 2 and driven gear 9. Each bearing 10 is fixed to a frame 12 via a compression springs 11', and charger roller 2 is in contact with OPC drum 1 at a uniform pressure at any time by compression springs 11'. Such a bearing/spring arrangement is shown, for example, in U.S. Pat. No. 5,465,136 to Kazushi Watanabe entitled Image Forming Apparatus And Process Cartridge Detachable Thereto With Charging Member Pressure Contact Release Feature.

When OPC drum 1 is not rotated, however, charger roller 2 and OPC drum 1 still maintain contact. Accordingly, as noted in the U.S. Pat. No. 5,465,136 patent, OPC drum 1 may become deformed or contaminated with material contained in charger roller 2, when charger roller 2 and OPC drum remain in contact for a long period of time without rotation. Accordingly, characteristics of OPC drum 1 become poor and toner development is performed abnormally, yielding a distorted print image or poor printing.

SUMMARY OF THE INVENTION

In view of the above, it is an object of the present invention to provide a contamination preventive system of an OPC drum in an image forming apparatus.

It is another object to prevent the charger roller from remaining in contact with the OPC drum when the OPC drum is not being rotated.

These and other objects are achieved by controlling contact and separation conditions between the OPC drum and the charger roller by utilizing a tension spring, which is connected between a frame and a bearing through which the shaft of the charger roller extends, for separating a driving gear of the OPC drum and a driven gear of the charger roller by a predetermined distance in order that the OPC drum and the charger roller can be separated while the OPC drum is at standstill, wherein the force of the tension spring is overcome by the force generated by the driving gear engaging the driven gear to enable the OPC drum and the charger roller to again contact each other while the OPC drum is rotated.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Hereinafter, the present invention is described in detail with reference to the appended drawings.

Figure 1:
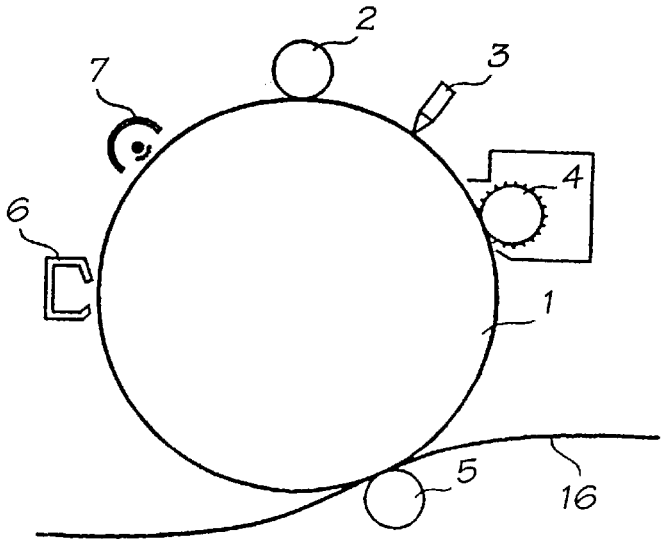
Fig. 1 (Prior Art)
FIG. 1 is a schematic view of an OPC drum employed in a typical prior art electrophotographic image forming device.
Figure 2A:
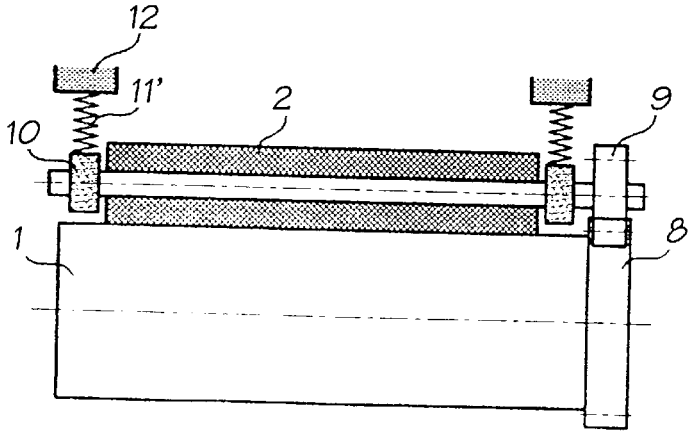
Fig. 2A (Prior Art)
FIGS. 2A and 2B are a section and a side elevation view, respectively, showing contact of the charger roller and the OPC drum of the prior art.
Figure 2B:
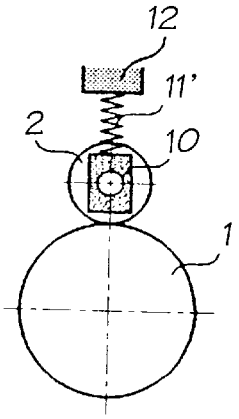
Fig. 2B (Prior Art)
Figure 3A:
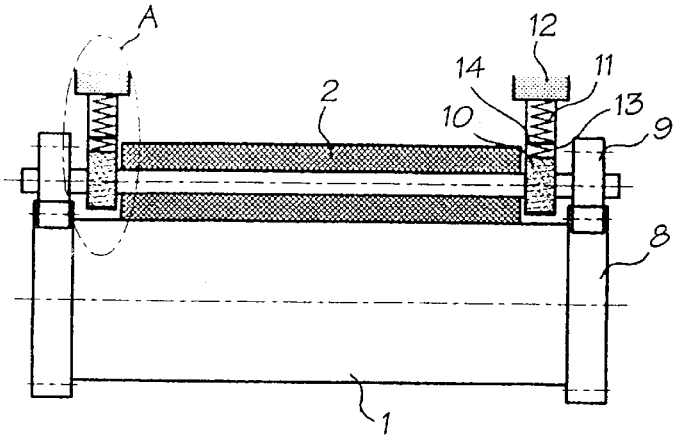
FIGS. 3A and 3B are a section and a side elevation view, respectively, showing contact of the charger roller and the OPC drum according to the principles of the present invention.

Referring first to the construction of FIG. 3A, driving gears 8 are provided at both ends of a shaft of OPC drum 1 in contact with charger roller 2, and a pair of driven gears 9 are provided at both ends of a shaft of charger roller 2, respectively, so that a driving force of driving gears 8 can be transmitted to driven gears 9. To support charger roller 2, a pair of bearing 10 are each provided on opposite sides of charger roller 2 between charger roller 2 and driven gears 9 and a shaft of charger roller 2 extends through central portions of both bearings 10. A tension spring 11 is provided in such a manner that one end is fixed to frame 12 and the other is fixed to bearing 10 through a hole formed through a partition 14.

Figure 3B:
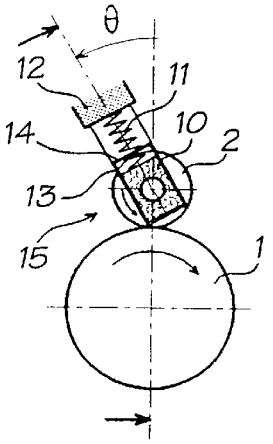
Figure 3C:
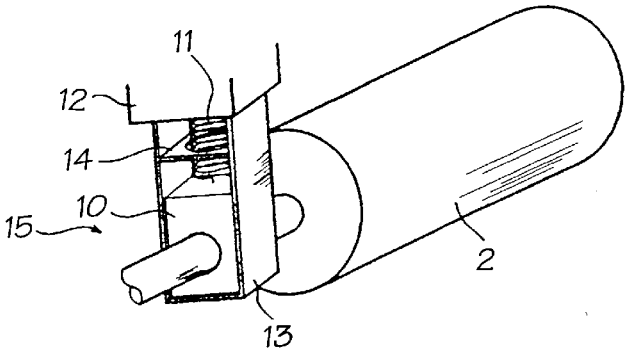
FIG. 3C is a detailed perspective view of a portion "A" shown in FIG. 3A according to the principles of the present invention.

As shown in FIGS. 3B and 3C, a guide member 15 is formed by a bracket 13 and partition 14. Bearing 10 is positioned in the lower portion of bracket 13 below partition 14. Thus bracket 13 guides bearing 10 when charger roller 2 is biased towards or away from OPC drum 1 and partition 14 limits the distance of bearings 10 can be moved. Guide member 15 is fixed to frame 12 and tension spring 11 is provided in such a manner that one end is fixed to frame 12 and the other is fixed to bearing 10 through a hole formed in partition 14. Guide member 15 forms a guide path for tension spring 11 and bearing 10 at a guide angle θ with respect to an imaginary vertical line linking the centers of the axes of charger roller 2 and OPC drum 1. The angle θ is defined by the following equation:

$$\frac{W}{\cos\theta} < f < F - \frac{W}{\cos\theta}$$

Where W is the summation weight of charger roller 2, bearing 10 and driven gear 9, f is the restoring force of tension spring 11, F is the normal force for driving the tooth surface of driven gear 9 responding to rotational torque of driving gear 8.

The operation of the foregoing device is provided in detail as follows. When OPC drum 1 is at a standstill, tension spring 11 separates charger roller 2 from OPC drum 1 to release the contact relation therebetween, and holds the weight of charger roller 2, bearing 10 and driven gear 9 in an equilibrium state at a distance $\delta_0$ shown in FIG. 4 which is permitted within the scope that the engagement of driving gear 8 and driven gear 9 is stilled maintained. Further, the distance $\delta_0$ shown in FIG. 4 can be controlled by the gap between partition 14 and the upper surface of bearing 10, and especially predetermined in a manner that driving gear 8 can still drive driven gear 9 in association with its movement on the point of starting the rotational movement.

Figure 4:
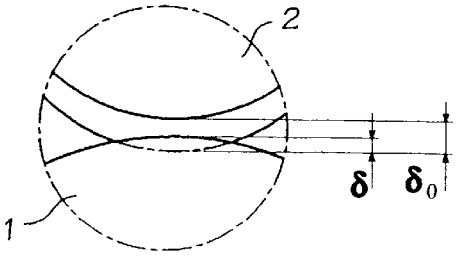
FIG. 4 is a diagrammatic section view showing engagement and separation of the charger roller and the OPC drum according to the principles of the present invention.

When OPC drum 1 starts to rotate, driven gear 9 receives the normal force F from driving gear 8, and this normal force F causes bearing 10 to move away from partition 14 in guide 15 to bring about contact between the OPC drum 1 and the charger roller 2, as shown in FIG. 3B. Accordingly, the distance between OPC drum 1 and charger roller 2 is changed from a distance $\delta_0$ to δ by the normal force F applied to the surface of driven gear 9, as shown in FIG. 4, where the distance δ corresponds to the pressing contact state between OPC drum 1 and charger roller 2. Here, it is noted that guide angle θ may be larger than a pressure angle or a clamping pressure angle between the gears while smaller than 90 degrees.

As mentioned above, according to the present invention, the contact relation between the OPC drum and the charger roller is released when the OPC drum is at a standstill, and the possibility of deformation and contamination of the OPC drum from the charger roller is drastically reduced.

What is claimed is:

1. An electrophotographic image forming apparatus comprising:

a drum;

a driving gear mounted to a shaft of said drum;

a charger roller for placing a uniform electrostatic charge on said drum;

a driven gear mounted to a shaft of said charger roller and engaged with said driving gear, said driven gear being driven by a driving force generated by said driving gear; and means, connected between a frame of said electrophotographic image forming device and said shaft of said charger roller, responsive to said driving force for controlling said charger roller to contact said drum when said drum is rotated by said driving gear, said means comprising a tension spring for separating said charger roller from said drum when said drum is at a standstill to prevent contamination of said drum.

2. The electrophotographic image forming device as set forth in claim 1, said means further comprising:

a bearing through which said shaft of said charger roller extends, said bearing being positioned between said charger roller and said driven gear;

a guide bracket mounted to said frame, said bearing being positioned within said guide bracket; and a partition mounted to said guide bracket between said frame and said bearing, said partition having a hole therein through which said tension spring passes, said tension spring being connected to said frame and said bearing.

3. The electrophotographic image forming device as set forth in claim 2, wherein said partition is positioned a predetermined distance from said bearing and said tension spring moves said bearing said predetermined distance to separate said charger roller from said drum by said predetermined distance when said drum is at a standstill.

4. The electrophotographic image forming device as set forth in claim 2, wherein said means forms a guide path at a guide angle less than 90 degrees from vertical.

5. The electrophotographic image forming device as set forth in claim 4, wherein said the tension spring has a restoring force f satisfying the following equation:

$$\frac{W}{\cos\theta} < f < F - \frac{W}{\cos\theta}$$

where W is a summation weight of said charger roller, said bearing and said driven gear, F is a normal force for driving a tooth surface of said driven gear responding to rotational torque of said driving gear, and θ is said guide angle.

6. The electrophotographic image forming device as set forth in claim 4, wherein said guide angle from vertical is larger than a clamping pressure angle between said driving gear and said driven gear.

7. The electrophotographic image forming device as set forth in claim 5, wherein said guide angle θ is larger than a clamping pressure angle between said driving gear and said driven gear.

8. A method for controlling contact between a charger roller and a drum of an electrophotographic image forming device, said method comprising the steps of:

raising said charger roller a predetermined distance above said drum by means of a tension spring to prevent said charger roller from contaminating or deforming said drum when said drum is at a standstill, said raising step comprising a step of moving a bearing rotatable supporting a shaft of said charger roller along a guide path formed by a bracket and limited by a partition positioned said predetermined distance from said bearing; and lowering said charger roller to contact said drum when said drum is rotated.

9. The method as set forth in claim 8, wherein said raising step further comprises:

raising said charger roller at an angle less than 90 degrees from vertical.

10. The method as set forth in claim 8, wherein said step of lowering comprises the steps of:

rotating a driving gear attached to a shaft of said drum for rotating said drum; and rotating a driven gear, attached to said shaft of said charger roller and engaged with said driving gear, in response to a driving force generated by the rotation of said driving gear, said driving force being greater than a restoring force of said tension spring for moving said charger roller into contact with said drum.

11. The method as set forth in claim 9, said step of lowering comprising the steps of:

rotating a driving gear attached to a shaft of said drum for rotating said drum; and rotating a driven gear, attached to said shaft of said charger roller and engaged with said driving gear, in response to a driving force generated by the rotation of said driving gear, said driving force being greater than a restoring force of said tension spring for moving said bearing said predetermined distance along said guide path in a direction opposite to the direction of movement caused by said tension spring.

12. The method as set forth in claim 11, said restoring force of said tension spring satisfying the following equation:

$$\frac{W}{\cos\theta} < f < F - \frac{W}{\cos\theta}$$

where f is said restoring force, W is a summation weight of said charger roller, said bearing and said driven gear, F is a normal force for driving a tooth surface of said driven gear responding to rotational torque of said driving gear, and θ is a guide angle of said guide path, said guide angle being less than 90 degrees from vertical.

13. An apparatus for preventing a charger roller from deforming or contaminating an organic photoconductive drum in an electrophotographic image forming device, comprising:

a tension spring connected to said charger roller for lifting said charger roller a predetermined distance above said organic photoconductive drum when said organic photoconductive drum is at a standstill; and means for generating a driving force greater than a restoring force of said tension spring to rotate said organic photoconductive drum and to lowering said charger roller to enable said charger roller to maintain uniform contact with said organic photoconductive drum.

14. The apparatus as set forth in claim 13, said means comprising:

a driving gear for generating said driving force, said driving gear being mounted to a shaft of said organic photoconductive drum; and a driven gear mounted to a shaft of said charger roller and engaged with said driving gear, said driven gear being driven by said driving force.

15. The apparatus as set forth in claim 13, further comprising:

a bearing for rotatably supporting a shaft of said charger roller;

a guide bracket mounted to said frame, said bearing being positioned within said guide bracket; and a partition mounted to said guide bracket between said frame and said bearing, said partition having a hole therein through which said tension spring passes, said tension spring being connected to said frame and said bearing.

16. The apparatus as set forth in claim 14, further comprising:

a bearing for rotatably supporting a shaft of said charger roller, said bearing being positioned between said charger roller and said driven gear;

a guide bracket mounted to said frame, said bearing being positioned within said guide bracket; and a partition mounted to said guide bracket between said frame and said bearing, said partition having a hole therein through which said tension spring passes, said tension spring being connected to said frame and said bearing.

17. The apparatus as set forth in claim 16, wherein said partition is positioned a predetermined distance from said bearing and said tension spring moves said bearing said predetermined distance to separate said charger roller from said organic photoconductive drum by said predetermined distance when said organic photoconductive drum is at a standstill.

* * * * *